US006796675B2

(12) United States Patent
Galli

(10) Patent No.: US 6,796,675 B2
(45) Date of Patent: Sep. 28, 2004

(54) MINIATURE FLASHLIGHT

(76) Inventor: Robert D. Galli, 8176 Horseshoe Bend La., Las Vegas, NV (US) 89113

( * ) Notice: Subject to any disclaimer, the term of this patent is extended or adjusted under 35 U.S.C. 154(b) by 156 days.

(21) Appl. No.: 10/248,487

(22) Filed: Jan. 23, 2003

(65) Prior Publication Data

US 2003/0090899 A1 May 15, 2003

Related U.S. Application Data

(63) Continuation-in-part of application No. 09/893,852, filed on Jun. 28, 2001, now Pat. No. 6,530,672, which is a continuation of application No. 09/374,658, filed on Aug. 16, 1999, now abandoned.

(51) Int. Cl.[7] ..... F21L 4/04

(52) U.S. Cl. ..... 362/200; 362/201; 362/116; 362/196; 362/208; 362/189; 362/204; 362/205; D26/38; 200/60

(58) Field of Search ..... 362/200, 201, 362/116, 196, 208, 189, 204, 205; D26/38; 200/60

(56) References Cited

U.S. PATENT DOCUMENTS

| | | | | |
|---|---|---|---|---|
| 5,924,557 A | * | 7/1999 | Pollock | 200/534 |
| 6,523,973 B2 | | 2/2003 | Galli | 362/200 |
| 6,530,672 B2 | * | 3/2003 | Galli | 362/200 |

FOREIGN PATENT DOCUMENTS

| | | | |
|---|---|---|---|
| GB | 2 314 150 | 12/1997 | F21L/7/00 |

* cited by examiner

*Primary Examiner*—Stephen Husar
*Assistant Examiner*—Bertrand Zeade
(74) *Attorney, Agent, or Firm*—Barlow, Josephs & Holmes, Ltd.

(57) ABSTRACT

A miniature flashlight consists of a housing, a light emitting diode (LED), a pair of batteries, and a flexible cover and a contact device that acts as both a momentary contact and a conventional switch. The LED is received in a seat formed in the housing with the head portion of the diode received in an aperture in the side wall of the housing. A longer contact arm is captured in a channel formed in the bottom wall. A shorter contact arm rests on a shoulder that forms part of the LED seat. A pair of coin cell batteries are received within another seat formed in housing. The lower battery sits on top of the longer contact arm captured in the channel of the bottom wall. A resilient plastic cover is assembled with the housing to maintain the diode and the batteries within the housing. The first end of the contact clip is frictionally engaged by pins within the housing and a contact arm engages the second contact of the diode, while the opposing second end is a flexible contact switch disposed in spaced relation over the upper surface contact of the upper battery. The cover is selectively depressible, i.e. deformable, to selectively depress the flexible contact on the second end of the contact device into electrical communication with the upper surface of the upper battery to energize the diode. A slide switch is also include in the bottom of the housing and engages a set of auxiliary contacts on the contact device to provide a selectable on or off position in addition to the momentary contact of the flexible contact.

10 Claims, 25 Drawing Sheets

MINIATURE FLASHLIGHT

CROSS REFERENCE TO RELATED APPLICATIONS

This application is a continuation in part of application Ser. No. 09/893,852, filed Jun. 28, 2001, now U.S. Pat. No. 6,530,672; which is a continuation in part of application Ser. No. 09/374,658, filed Aug. 16, 1999, now abandoned.

BACKGROUND OF INVENTION

The instant invention relates to miniature lighting devices, such as key lights, and small personal flashlights, and more particularly to miniature flashlights of the type employing a high brightness light emitting diode.

The recent development of low cost, high brightness diodes, i.e. light emitting diodes, or LED's, has provided light manufacturers with a new alternative to conventional filament light bulbs as a light source in flashlights and other types of small personal lights. While there are many different types and kinds of lights, there is always a need for newer constructions and arrangements which reduce the number of parts, simplify manufacturing procedures, and ultimately reduce cost.

SUMMARY OF INVENTION

In this regard, the instant invention provides an improved miniature flashlight construction comprising a housing, a light emitting diode (LED), a pair of batteries, a flexible cover, and a contact member mounted on the Inside of the housing that acts as a switch. The housing includes a bottom wall, and a continuous side wall extending upwardly from the bottom wall, wherein the bottom wall and side wall cooperate to form an upwardly opening interior cavity for receiving the batteries, and LED therein. The LED has a head portion and two spaced contact arms extending rearwardly from the head portion. One of the contact arms is shorter than the other and is used as part of the switch mechanism. In this regard, a conventional LED is normally provided with two identical contact arms. The shorter contact arm in the present invention is created by trimming one of the contact arms. The LED is received in a seat formed in the housing with the head portion of the diode received in an aperture in a side wall of the housing. The longer contact arm extends along the bottom wall of housing and is captured in a longitudinal channel formed in the bottom wall. The shorter contact arm rests on a raised shoulder that is formed as part of the LED seat. A pair of coin cell batteries are piggy-backed and received within another seat formed in housing. The lower contact surface of the lower battery sits on top of the longer contact arm captured in the channel of the bottom wall. The contact member is Installed into a groove in the raised shoulder wherein a first end thereof contacts the shorter contact arm and retains the LED in position. An opposing second end of the contact member comprises a dome switch that is disposed in spaced relation over the upper surface contact of the upper battery. To complete the assembly, the resilient plastic cover is frictionally received in assembled relation with the side walls of the housing to maintain the batteries within the housing.

In operation, the cover is selectively depressible, i.e. deformable, to selectively operate the dome switch into electrical communication with the upper surface of the battery to selectively energize the diode. This provides a momentary switching mechanism. In addition, a slide switch is provided for selective engagement with an auxiliary contact to provide the flashlight with a continuous on setting.

Accordingly, among the objects of the instant invention are: the provision of small, lightweight, low cost flashlight having a superior brightness level, and extended longevity; the provision of a miniature flashlight construction that utilizes a high brightness LED as a light source; the provision of a miniature flashlight that uses a resilient housing portion as part of the switch arrangement; the provision of a miniature flashlight having a reduced number of parts; and the provision of a miniature flashlight that can be disassembled to replace spent batteries.

Other objects, features and advantages of the invention shall become apparent as the description thereof proceeds when considered in connection with the accompanying illustrative drawings.

BRIEF DESCRIPTION OF DRAWINGS

In the drawings which illustrate the best mode presently contemplated for carrying out the present invention.

DETAILED DESCRIPTION

Figure 1:
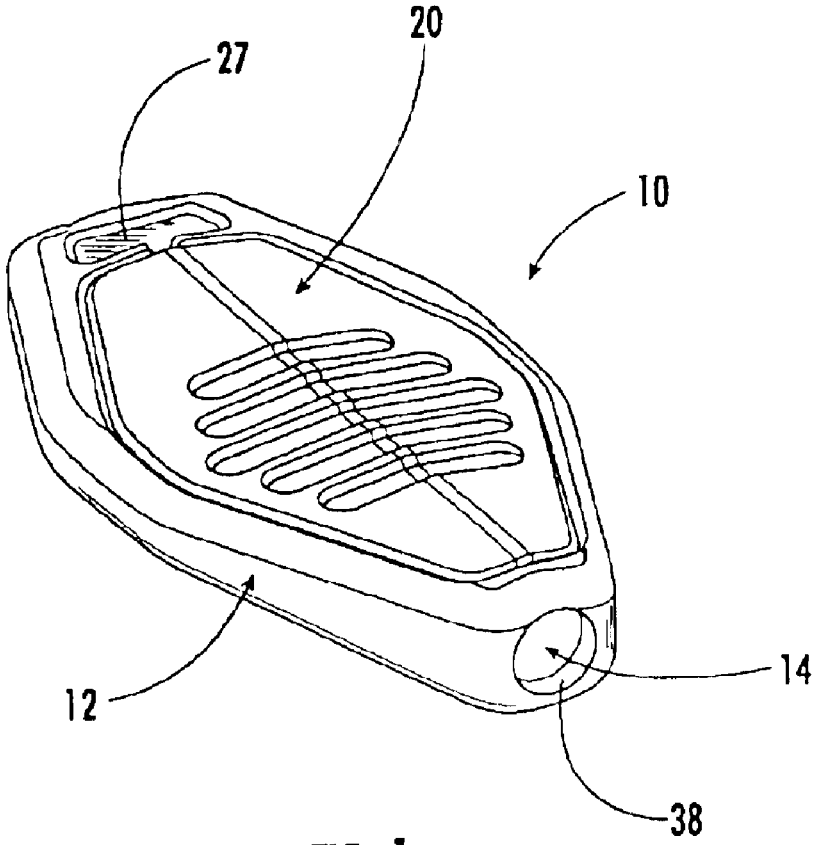
FIG. 1 is a perspective view of a first embodiment of the miniature flashlight of the present invention.
Figure 2:
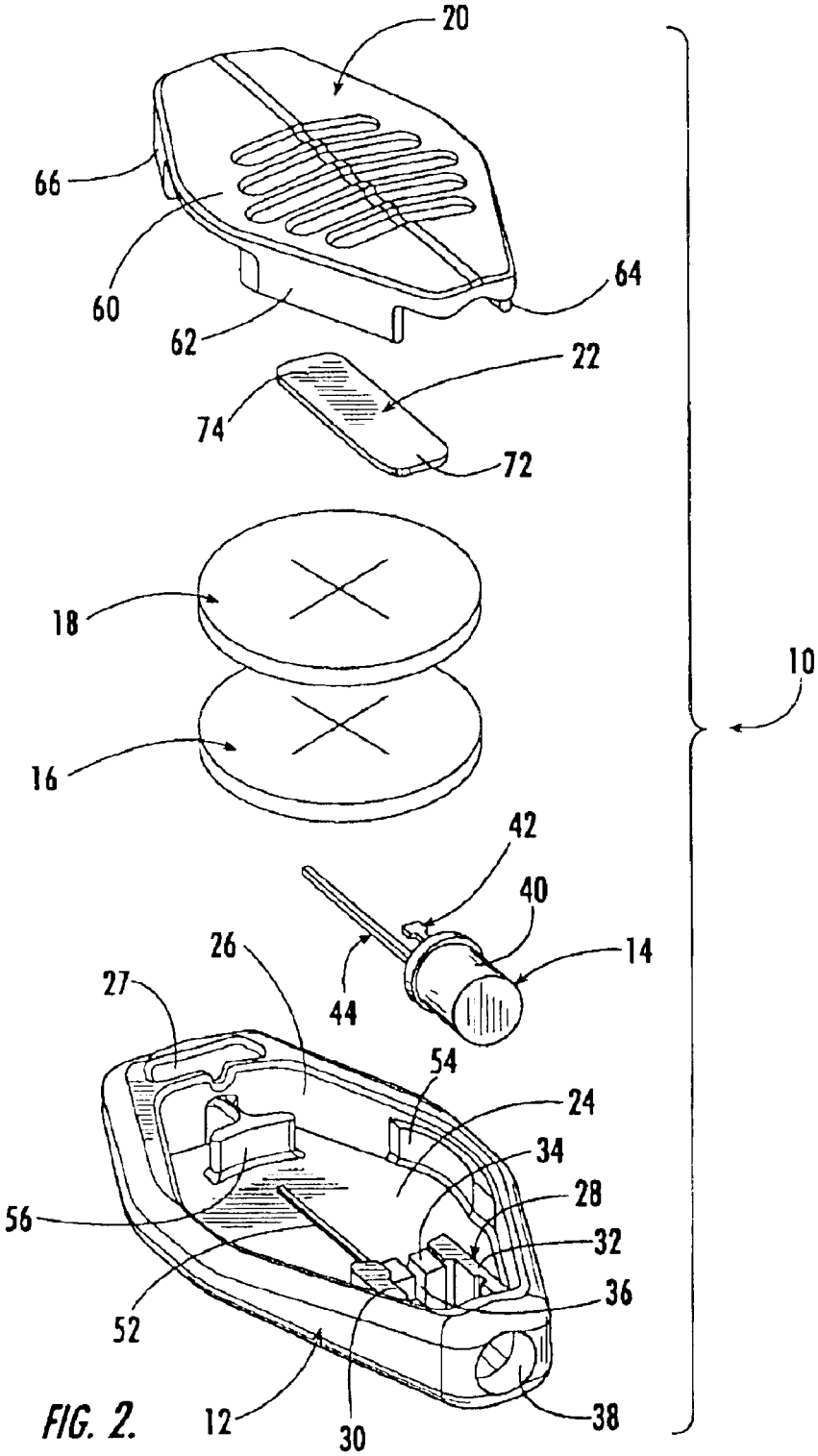
FIG. 2 is an exploded perspective view thereof.
Figure 3:
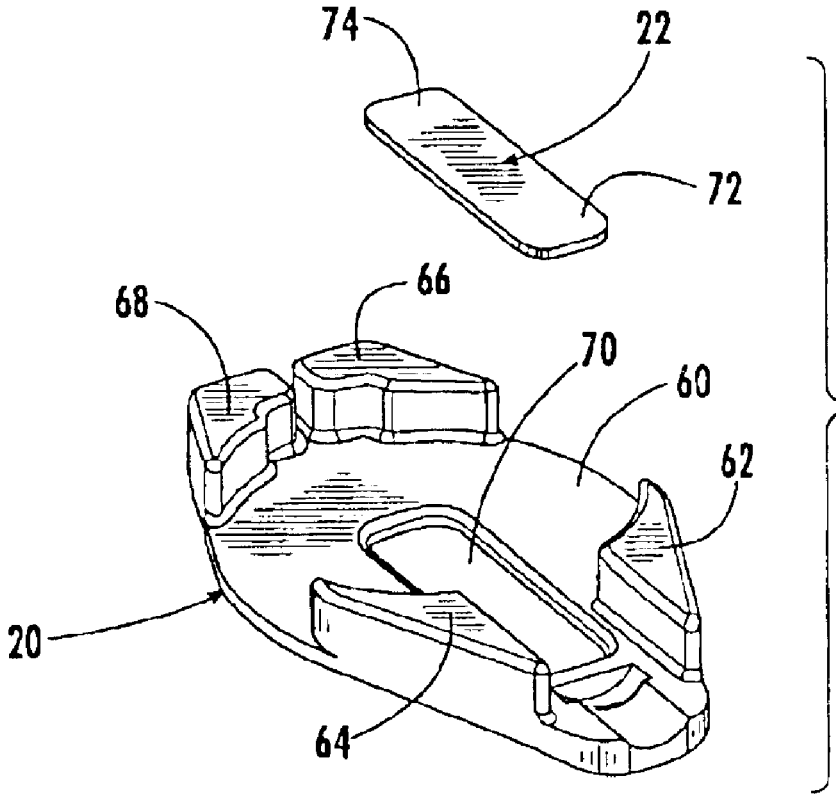
FIG. 3 is an exploded perspective view of the cover assembly thereof.

Referring now to the drawings, a first embodiment of the miniature flashlight of the instant invention is illustrated and generally indicated at 10 in FIGS. 1–10. As will hereinafter be more fully described, the instant invention utilizes a high brightness light emitting diode, and long life lithium coin cell batteries in a simple housing to provide a useful, novel and improved flight source.

The flashlight 10 comprises comprising a housing generally indicated at 12, a light emitting diode (LED) generally indicated at 14, a pair of batteries respectively generally indicated at 16 and 18, a cover generally indicated at 20, and in the first embodiment, a contact strip 22 mounted on the inside of the cover 20.

The housing 12 is generally diamond shaped and is preferably molded from a rigid plastic material suitable for housing the types of electronic components discussed herein. Generally speaking the housing 12 is approximately the same size as a conventional keyless alarm device provided for many vehicles. However, it is noted that this size is not critical to the device, and is not intended to limit the scope of the disclosure in any way. The housing 12 includes a bottom wall 24, and a continuous side wall 26 extending upwardly from the bottom wall 24. The bottom wall 24 and side wall 26 cooperate to form an upwardly opening interior cavity for receiving the batteries 16, 18, and LED 14 therein. The housing 12 further includes an external aperture 27 in the rear end for receiving a key chain or other type of clip, and an internal seat generally Indicated 28 at for receiving the LED 14. The seat 28 is formed by two vertical side walls 30, 32 and a rear wall 34 extending upwardly from the bottom wall 24. The rear wall 34 includes a slot 36 for receiving the contact arms of the LED 14 when inserted into the seat 28. The front of the seat 28 opens into a longitudinally extending aperture 38 sized to receive a head portion of the LED 14.

Figure 4:
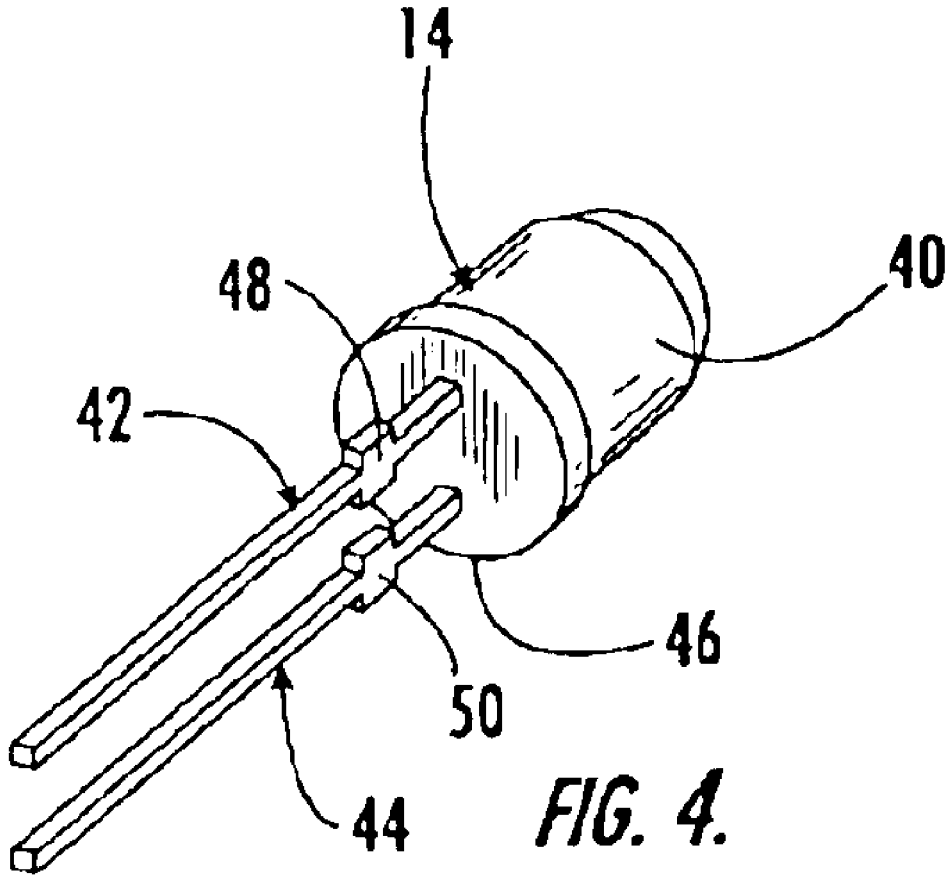
FIG. 4 is a perspective view of the LED thereof prior to trimming of the upper contact.
Figure 5:
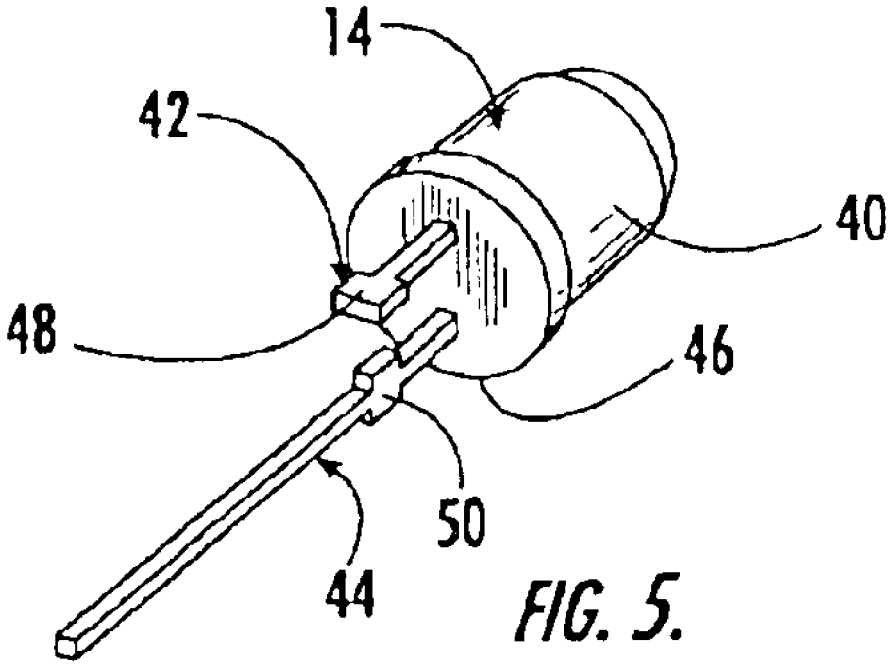
FIG. 5 Is another perspective view of the LED thereof after trimming of the upper contact.
Figure 6:
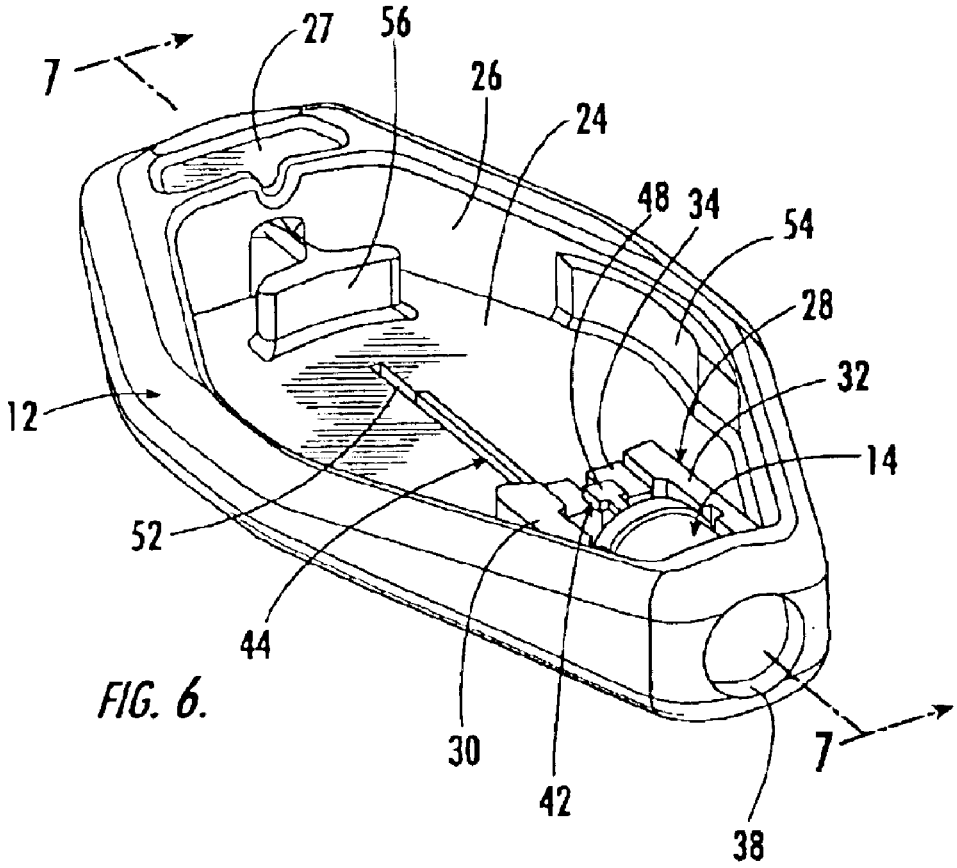
FIG. 6 is a perspective view of the housing thereof with the cover assembly and batteries removed.
Figure 7:
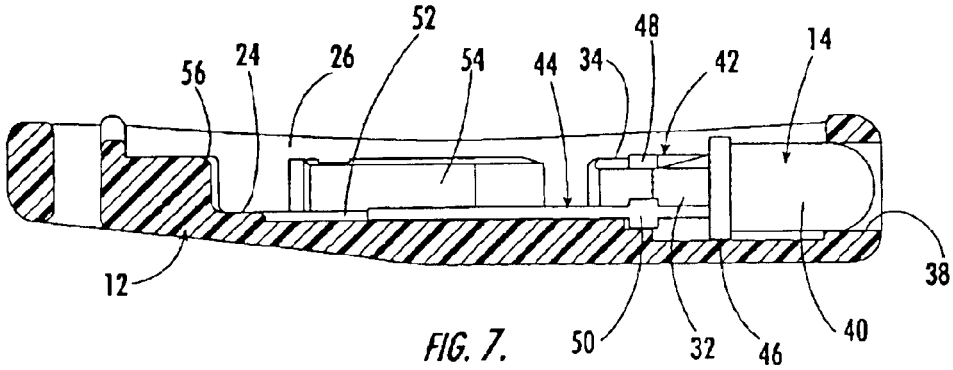
FIG. 7 is a cross-sectional view thereof as taken along line 7—7 of FIG. 6.
Figure 8:
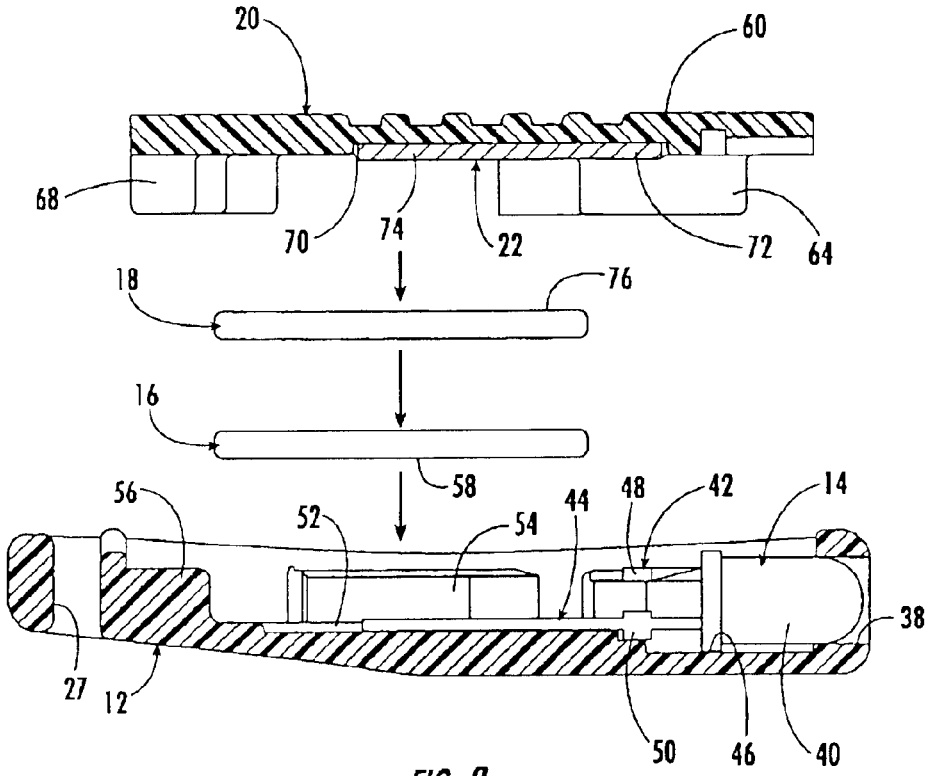
FIG. 8 is another cross-sectional view thereof showing insertion of the batteries and cover assembly.

Referring to FIGS. 4 and 5, the LED 14 preferably comprises a high brightness, gallium nitride LED. The gallium LED 14 emits a soft blue wavelength of light that is particularly suitable for use as a multipurpose flashlight. The gallium LED 14 typically requires an operating voltage of about 4.5 volts which thus requires the use of two 3.0 volt lithium coin cells 16 and 18 (CR2016). Other types of LED's are also suitable, such as gallium phosphide red and green LED's. These LED's typically have an operating voltage of about 2.0 volts and require only a single lithium coin cell (CR2032) (not shown). The LED's and batteries are Interchangeable in the present configuration so that manufacturing is not limited to single source suppliers. The shape of an LED 14 is standard throughout the industry comprising a head portion 40 and two spaced contact arms generally indicated at 42, 44 extending rearwardly from the head portion 40. The head portion 40 further includes a flat shoulder 46 which can be used for alignment of the head 40 in assembly. For assembly in the housing 12, one of the contact arms 42 is shorter than the other 44, and in the first embodiment includes a contact plate, i.e. stop plate, 48 that is used as part of the switch mechanism. Referring to FIG. 4, a conventional LED is provided with two identical contact arms 42, 44 each having a stop plate 48, 50 adjacent to the head portion 14. The stop plates 48, 50 are typically used as a shoulder stop when inserting the LED 14 into a circuit board. The shorter contact arm 42, as illustrated in FIG. 5 is created by trimming the contact arm 42 at the end of the stop plate 48 and rotating the contact arm 42 by 90 degrees so that the stop plate 48 is presented for use as a horizontal contact plate. Turning to FIGS. 6, 7 and 8, the LED 14 is received in the seat 28 with the head portion 40 thereof received in the aperture 38. The longer contact arm 44 is slid into the slot 36 in the rear wall 35 of the seat and extends along the bottom wall 24 of housing 12 where it is captured in a longitudinal channel 52 formed in the bottom wall 24. In FIG. 8 it can be seen that the upper edge of the contact arm 44 projects upwardly above the surface of the bottom wall 24 to engage the batteries 16,18 to be inserted into the housing 12. The stop plate 50 of the longer contact arm 44 rests within the slot 36 in the seat, and the stop plate 48 of the shorter contact arm 42 rests on top of the rear wall 34 bridging the slot 36 that receives the longer arm 44.

Figure 9:
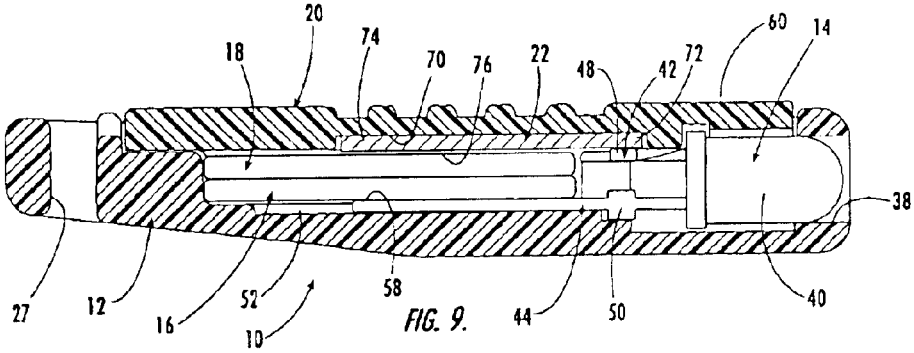
FIG. 9 is a cross-sectional view of the assembled flashlight as taken along line 9—9 of FIG. 1.
Figure 10:
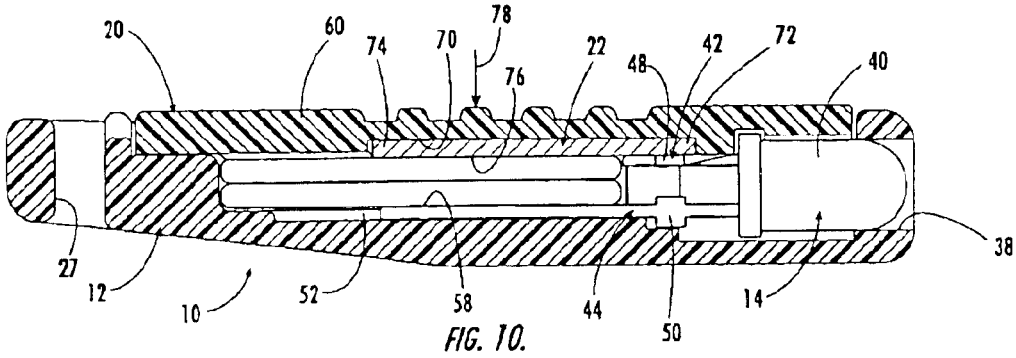
FIG. 10 is another cross-sectional view showing depression of the cover assembly and closure of the electrical circuit to energize the LED.
Figure 11:
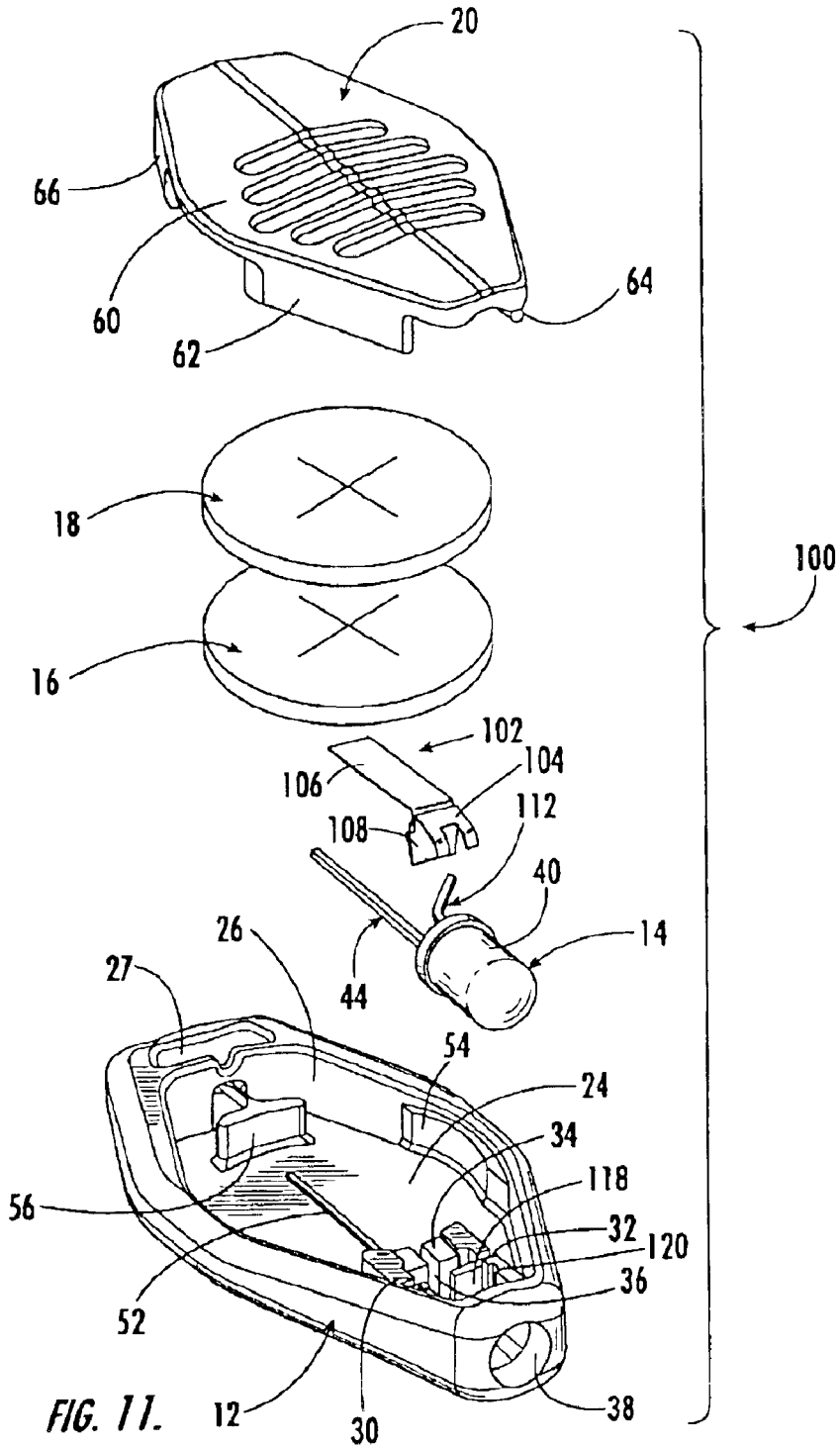
FIG. 11 is an exploded perspective view of a second embodiment of the miniature flashlight.
Figure 12:
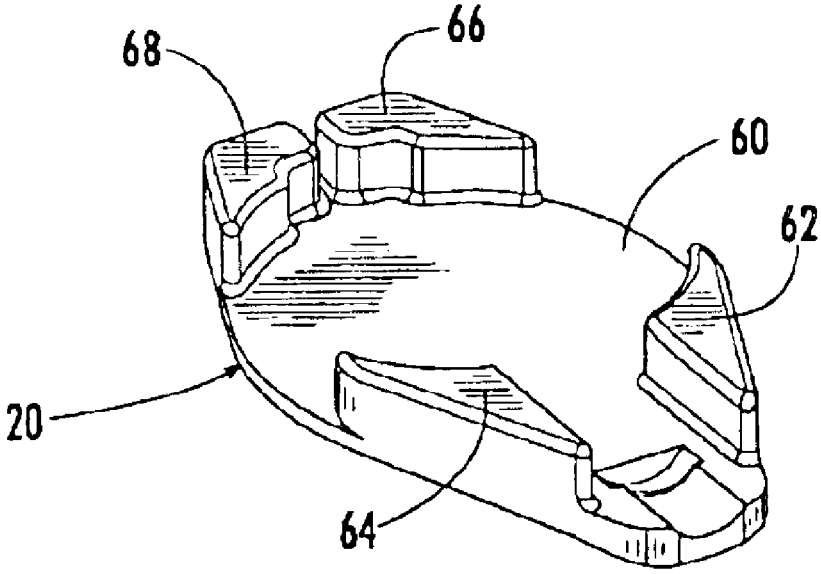
FIG. 12 is a perspective view of the cover thereof.

As indicated above, the coin cell batteries 16, 18 comprise a pair CR2016 lithium batteries that are piggy backed and received into the housing 12. In this regard, the side wall 26 of the housing 12 is provided with symmetrically opposed side shoulders 54 (only one shown) and rear shoulder 56 that cooperate to position the batteries 16, 18 within the housing 12. Referring now to FIGS. 8–10, the lower contact surface 58 of the lower battery 16 sits on top of the longer contact arm 44 captured In the channel 52 of the bottom wall 24.

The cover 20 is generally diamond shaped to match the housing 12 and is preferably molded from a resilient plastic, or elastomeric material, that is capable of flexing. The cover 20 includes a top wall 60, and symmetrically opposed insert legs 62, 64, and 66, 68 that are sized and configured to be received in assembled relation within the interior surfaces of the side wall 26 of the housing 12. In this regard, the cover 20 is maintained in position by friction between the outside surfaces of the insert legs 62, 64, 66, 68 and the interior surfaces of the side walls 16. The existing friction is sufficient to maintain the cover 20 in position, yet will allow the cover 20 to be removed when the batteries 16, 18 need to be replaced.

The contact strip 22 is mounted in a recess 70 on the inside surface of the top wall 60. When the cover 20 is assembled with the housing 12, the first end 72 of the contact strip 22 engages the stop plate 48 of the short contact 42 of the diode 14, while the opposing second end 74 of the contact strip is disposed in spaced relation over the upper surface 76 contact of the upper battery 18 (See FIG. 9).

Referring to FIGS. 9 and 10, the contact strip 22 is normally spaced over the upper surface 76 of the upper battery 18 to maintain the circuit in an open condition. However, the center portion of the top wall 60 of the cover 20 is depressible, i.e. resiliently deformable, upon downward pressure (see arrow 78 FIG. 10), to selectively move the second end 74 of the contact strip 22 into electrical communication with the upper surface 76 of the upper battery 18 to close the circuit and selectively energize the diode 14. Release of pressure from the cover 20 allows the cover 20 to return to its normal shape (FIG. 9) and withdraws the contact strip 22 from engagement with the battery 18.

Referring now to FIGS. 11–18 a second embodiment of the invention is illustrated and generally indicated as 100.

The construction of the flashlight 100 is generally the same as in the first embodiment 10, with a few variations in the housing, circuitry and switch mechanism.

In the second embodiment, the contact strip 22 is replaced with a combination retaining clip and spring biased contact generally indicated at 102, and the orientation of the LED contacts is slightly different to accommodate the retaining clip 102.

Figure 15:
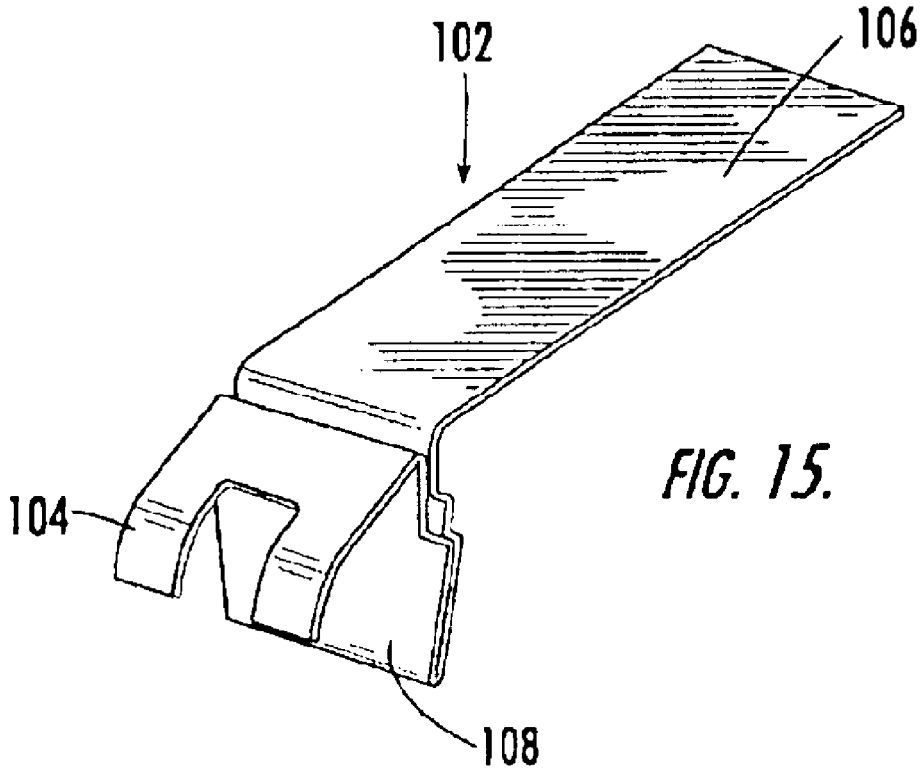
FIG. 15 is perspective view of the contact clip thereof.

The retaining clip 102, shown in FIG. 15, comprises a unitary strip of spring metal being bent in such a fashion to serve as a retainer and a spring biased contact switch. The retaining clip 102 has three distinct portions having a stationary end 104, a movable end 106 and an intermediate portion bent over on itself to form a spring tab 108. The stationary end is bent downwardly and includes a slot at the forward end for receiving a contact of the LED, the relationship of which will be described hereinafter.

Figure 13:
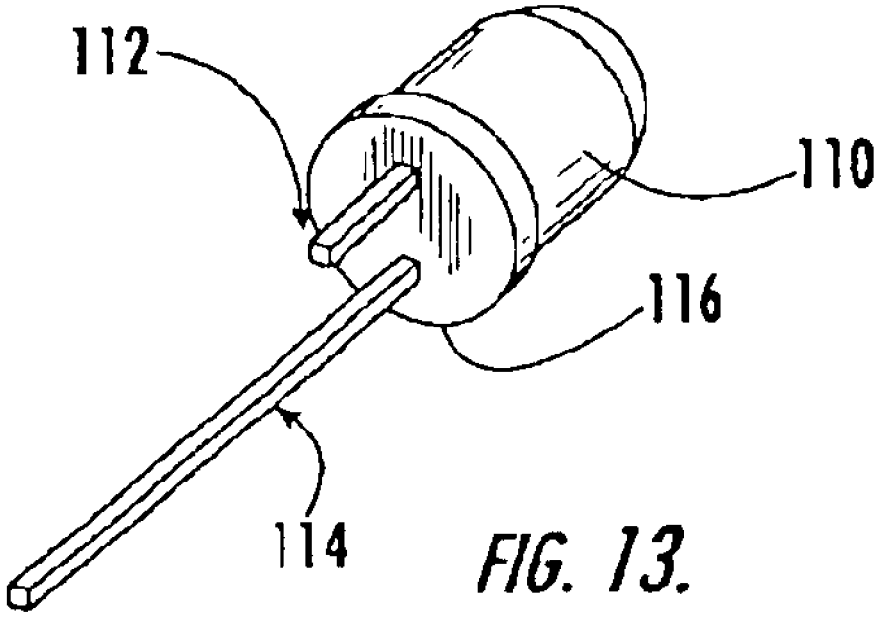
FIG. 13 is a perspective view of the LED thereof after trimming of the upper contact.
Figure 14:
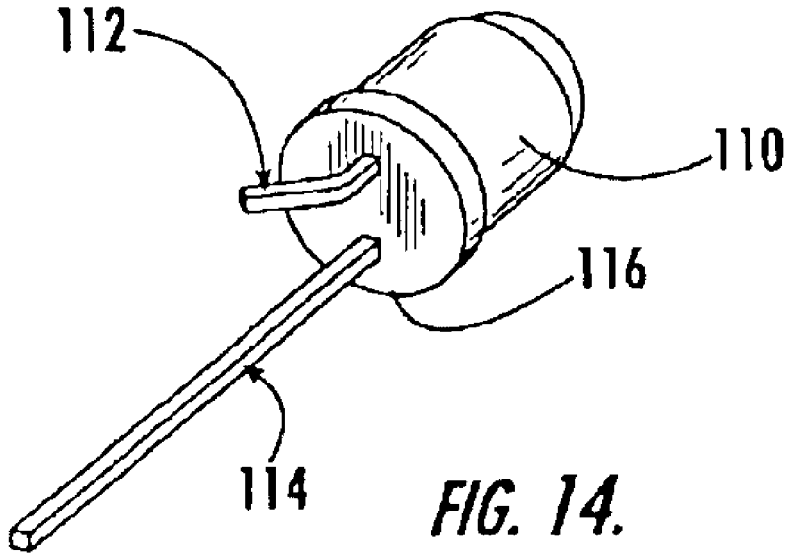
FIG. 14 is a perspective view of the LED after bending of the upper contact.

The LED shown In FIGS. 13 and 14 comprises a head portion 110 and two spaced contact arms generally indicated at 112, 114 extending rearwardly from the head portion 110. The head portion 110 further includes a flat shoulder 116 which can be used for alignment of the head 110 in assembly. For assembly in the housing 12, the upper contact arm 112 is shorter than the other 114, and is bent at a slight angle as illustrated in FIG. 14 so that it will rest on the intermediate shoulder 118. Referring to FIG. 13, a conventional LED is provided with two identical contact arms 112,114 adjacent to the head portion 110. The shorter contact arm 112 is created by trimming the contact arm 112 at and bending the contact arm 112 a few degrees out of the plane that aligns with the longer contact arm 114 so that when the LED 110 is installed in the housing 12 the shorter arm rests on an intermediate shoulder 118 of the seat 28 of the housing 12 and is presented for use as a contact point.

Figure 16:
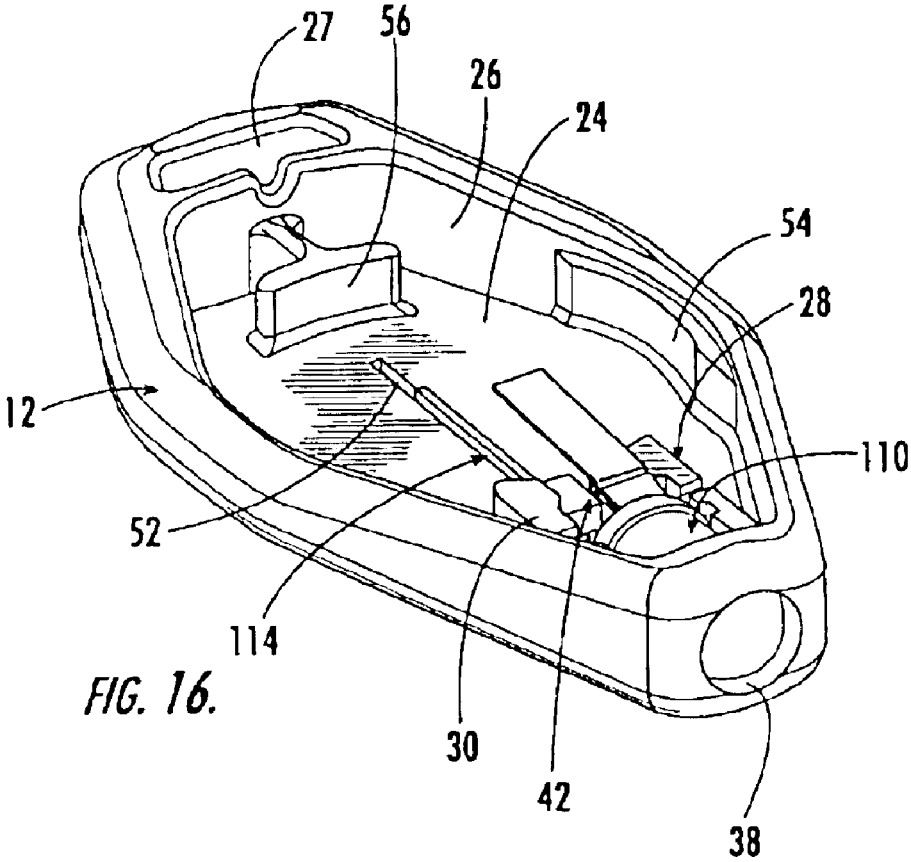
FIG. 16 is a perspective view of the housing with the cover assembly, contact clip and batteries removed.
Figure 17:
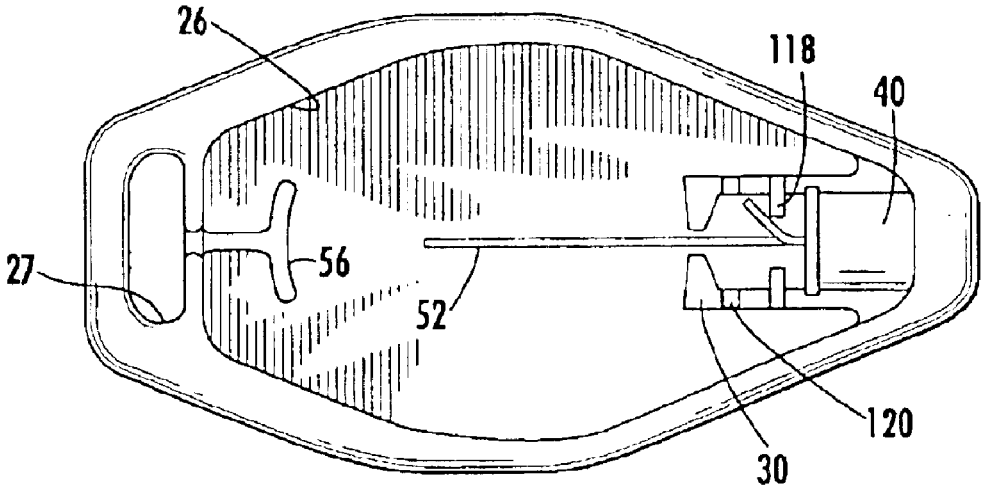
FIG. 17 is a top view thereof showing location of the LED and contacts.

Turning to FIGS. 16 and 17, the seat 28 for the LED is also slightly different to accommodate and receive the spring tab 108 of the retaining clip 102. In this regard, the seat 28 for the LED is formed by two vertical side walls 30, 32, a rear wall 34 and an intermediate shoulder 118 extending upwardly from the bottom wall 24. The rear wall 34 includes a slot 36 for receiving the longer contact arm 114 of the LED 110 when inserted into the seat 28. The front of the seat 28 opens into a longitudinally extending aperture 38 sized to receive a head portion of the LED 110.

Figure 18:
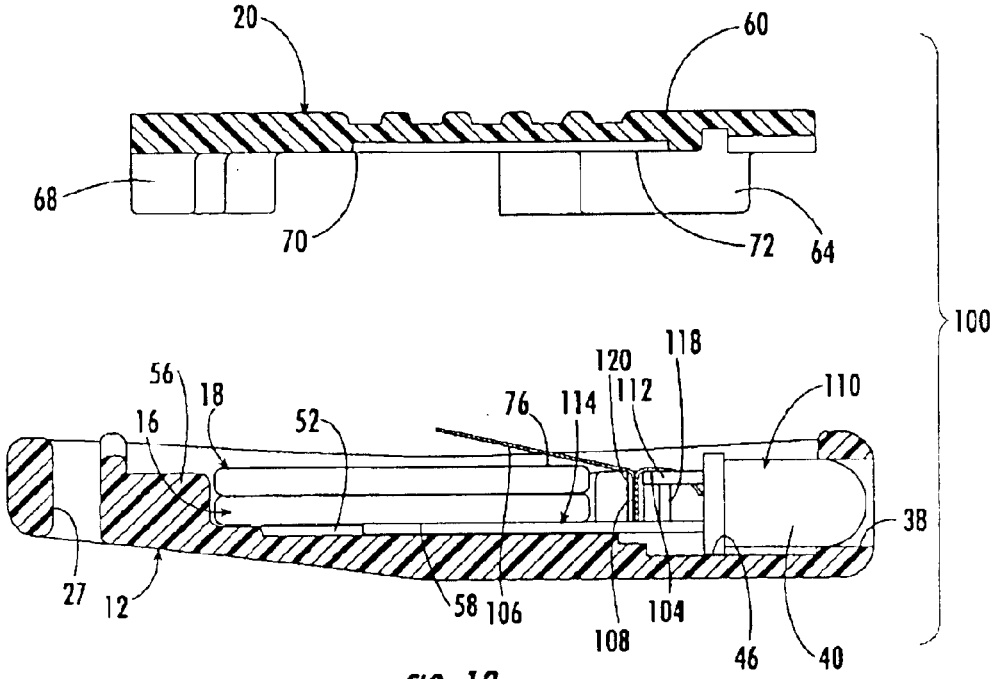
FIG. 18 Is a cross-sectional assembly view thereof showing assembly of the batteries, contact clip and cover assembly.
Figure 19:
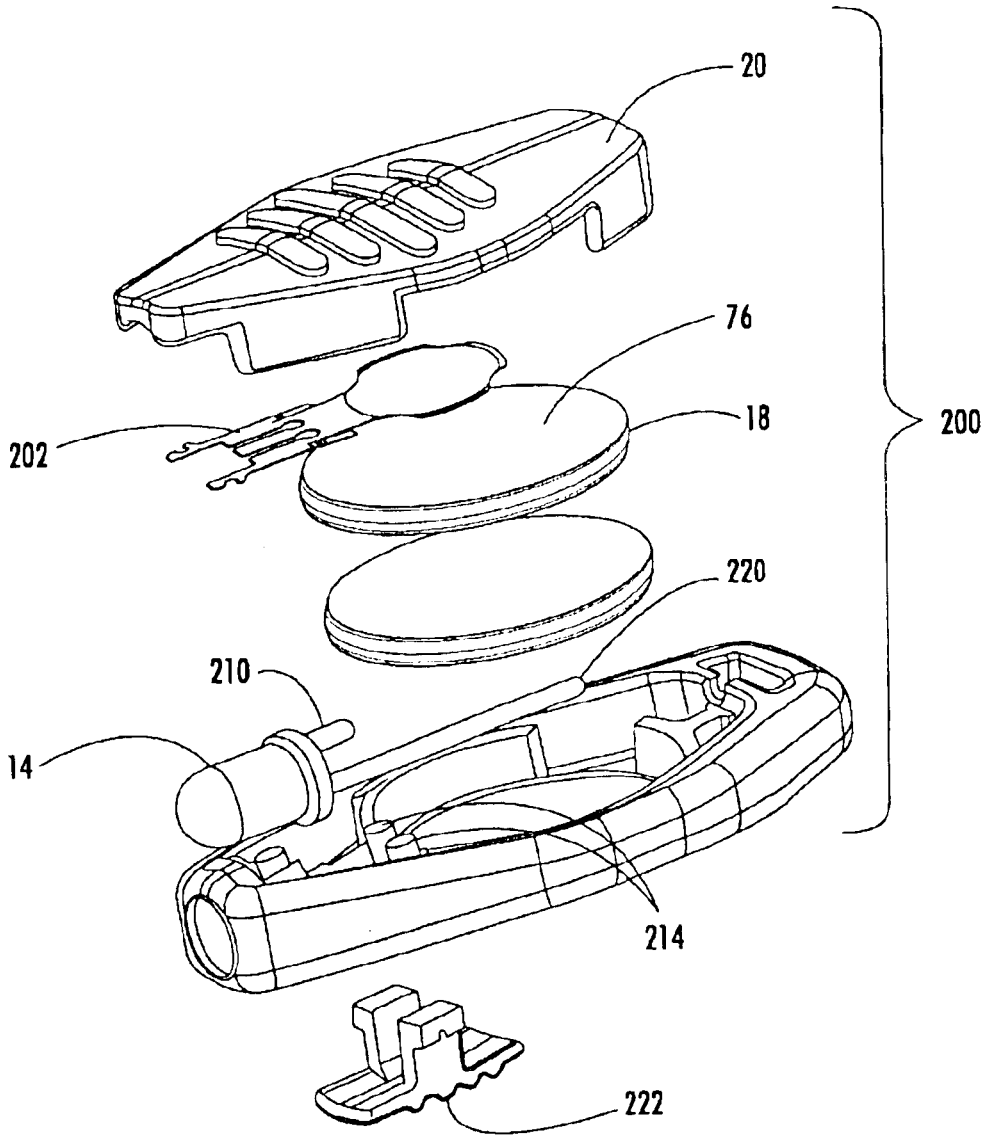
FIG. 19 is an exploded perspective view of a third embodiment of the miniature flashlight of the present invention.

The LED 110 is received in the seat 28 with the head portion 110 thereof received in the aperture 38. The longer contact arm 114 is slid into the slot 36 in the rear wall 35 of the seat and extends along the bottom wall 24 of housing 12 where it is captured in a longitudinal channel 52 formed in the bottom wall 24. In FIG. 18 it can be seen that the upper edge of the contact arm 114 projects upwardly above the surface of the bottom wall 24 to engage the batteries 16,18 to be inserted into the housing 12. The shorter contact arm 112 rests on top of the intermediate shoulder 118.

The spring tab 108 of the retaining clip 102 (shown in FIG. 15) is frictionally inserted into a groove 120 in the side walls 30, 32 of the seat 28 with a stationary contact end 104 being in electrical communication with the shorter LED contact arm 112. The stationary contact end of the contact clip 104 presses onto the shorter contact arm 112 retaining it against the Intermediate shoulder 118. This arrangement forms a biased engagement of the clip and contact to form a reliable circuit connection.

Referring to FIG. 18, the movable end 106 of the contact clip 102 is normally spaced over the upper surface 76 of the upper battery 18 to maintain the circuit in an open condition. However, the center portion of the top wall 60 of the cover 20 is depressible, i.e. resiliently deformable, upon downward pressure (see arrow 78 FIG. 10), to selectively move the second end 106 of the contact clip 102 into electrical communication with the upper surface 76 of the upper battery 18 to close the circuit and selectively energize the diode 14. Releasing of pressure from the cover 20 allows the cover 20 to return to its normal shape and releases the movable end 106 of the contact clip 102 from engagement with the battery 18.

A third embodiment of the present invention Is shown in FIGS. 19–23 and generally indicated as 200. The construction of the flashlight 200 Is generally the same as in the first embodiment 10 and the second embodiment 100, with a few variations in the housing, circuitry and switch mechanism.

Figure 20:
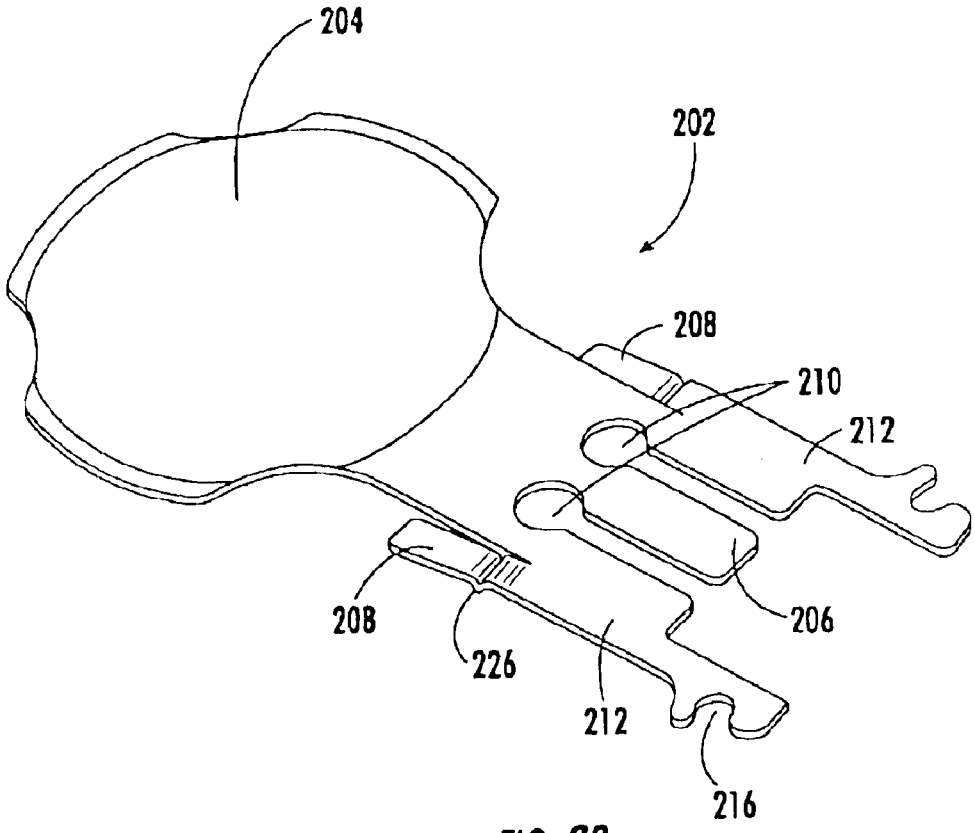
FIG. 20 is a perspective view of the switch device thereof.
Figure 20A:
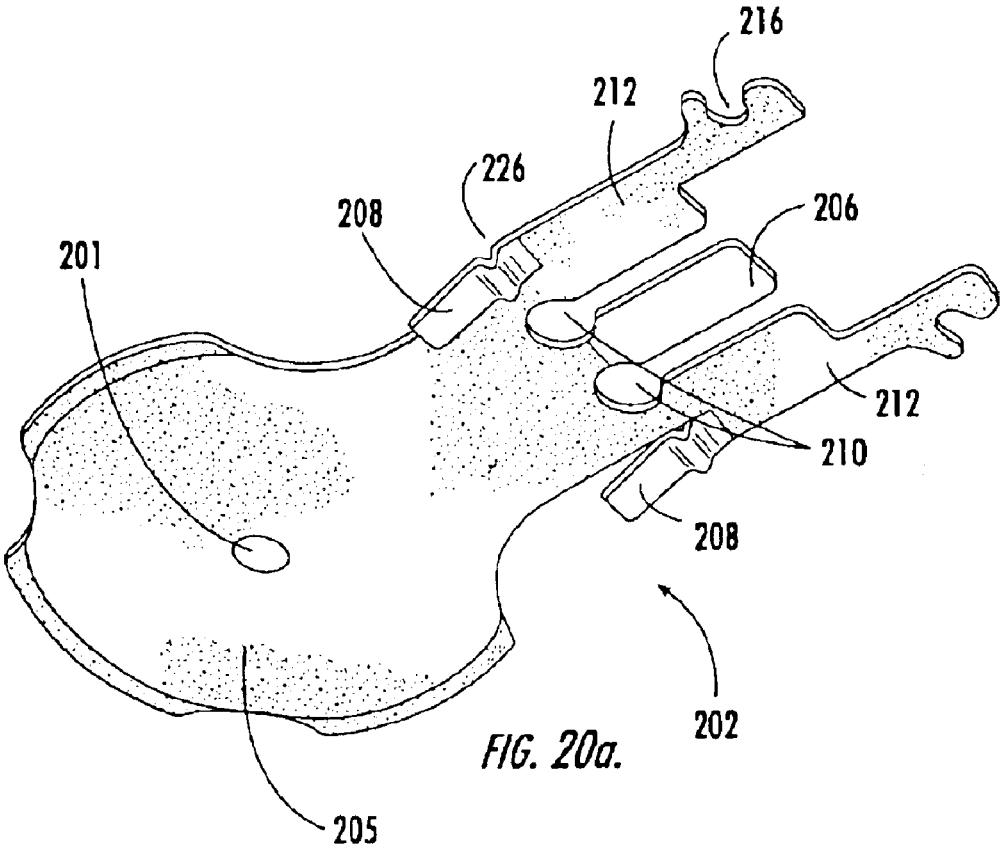
FIG. 20*a* is a perspective view of the bottom of the switch device thereof.

In the third embodiment, the contact strip 22 is replaced with a multi-function contact member 202 which serves as a retaining clip, spring biased contact and dome switch. The contact member 202, as best shown in FIG. 20, is stamped from a strip of spring metal so as to have biased contact portions. More specifically, the contact member is formed having four distinct portions including a dome switch section 204, auxiliary contacts 208, retaining arms 212 and an LED contact clip 206. The retaining arms 212 include holes 210 to receive posts 214 located In the flashlight housing 216 which hold the contact member 202 firmly in place. Auxiliary contacts 208 are bent downwardly so as to contact the upper surface 76 of the top battery 18 in their normal resting position. LED contact clip 206 Is also bent slightly downward to exert constant pressure and maintain contact with the upper contact lead 218 of LED 14. To insulate the dome switch portion 204 of the contact member 202 from the upper surface 76 of the battery 18, the lower surface of the dome 204 is selectively covered with a non-conductive coating. In particular, the outer peripheral edges 205 of the dome portion that actually rests on the upper surface 76 of the battery 18 include the non-conductive coating to prevent electricity from normally being conducted through the dome 204 when it is in the resting state in contact with the upper surface 76 of the battery 18. A small portion 207 of the non-conductive coating is removed near the center of the dome portion of the switch 205 to allow the center of the dome 204, when depressed, to make electrical contact with the battery and complete the circuit.

Figure 23:
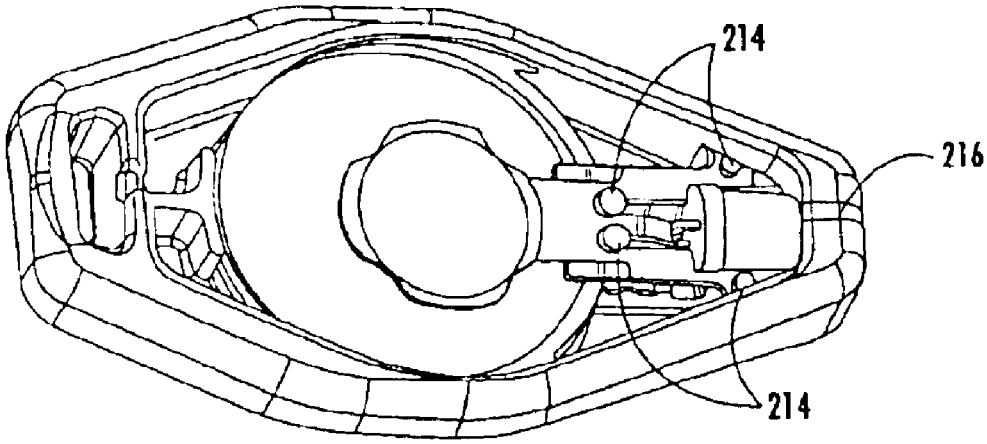
FIG. 23 is a top perspective view thereof with the cover removed.

Turning to FIG. 23, the flashlight 200 is assembled first by inserting LED 14 into the housing 216 with the lower contact lead 220 of the LED 14 against the inner surface of the housing 216 and the short upper contact lead 218 of the LED 14 facing upward. The batteries are installed in the housing 216 and the contact member 202 is then installed in the flashlight housing 216 by aligning the holes 210 in the retaining arms 212 with retaining pegs 214 that are located on the interior of the housing 216. The contact member 202 is pressed into place with the LED contact clip 206 in electrical communication with and firmly retaining upper contact lead 218 of the LED 14. The dome portion 204 of the contact member rests on upper surface 76 of the top battery 18. The retaining pegs 214 can be heated and pressed so as to mold over the retaining arms 212 and further retain the contact member 202. Resilient cover 20 is then installed over the top of the assembled flashlight 200 and can be selectively depressed to turn the flashlight on.

Figure 21:
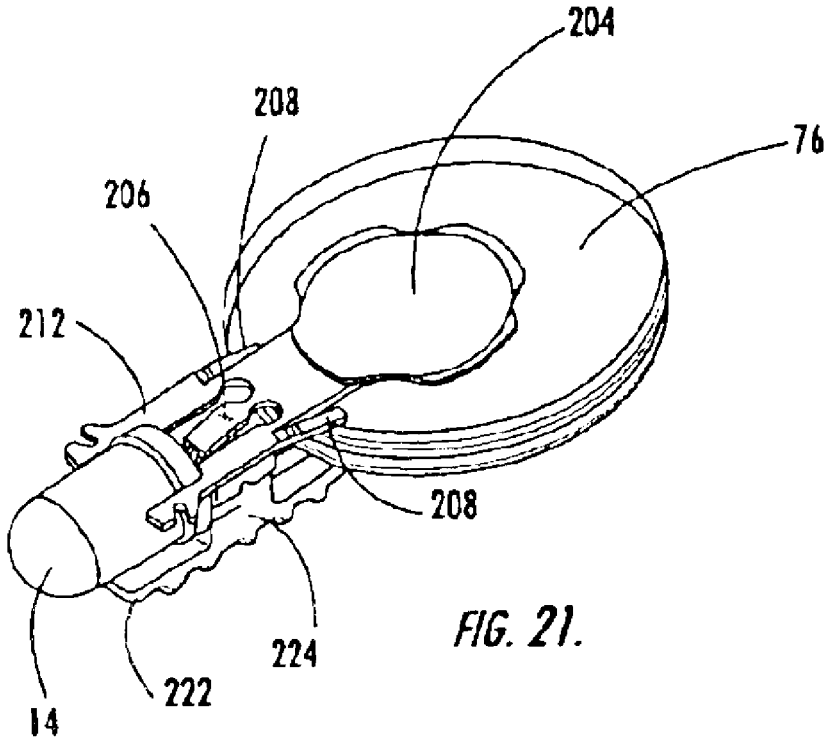
FIG. 21 is a perspective view of the miniature flashlight in the "on" position with the case and cover sections thereof removed.
Figure 22:
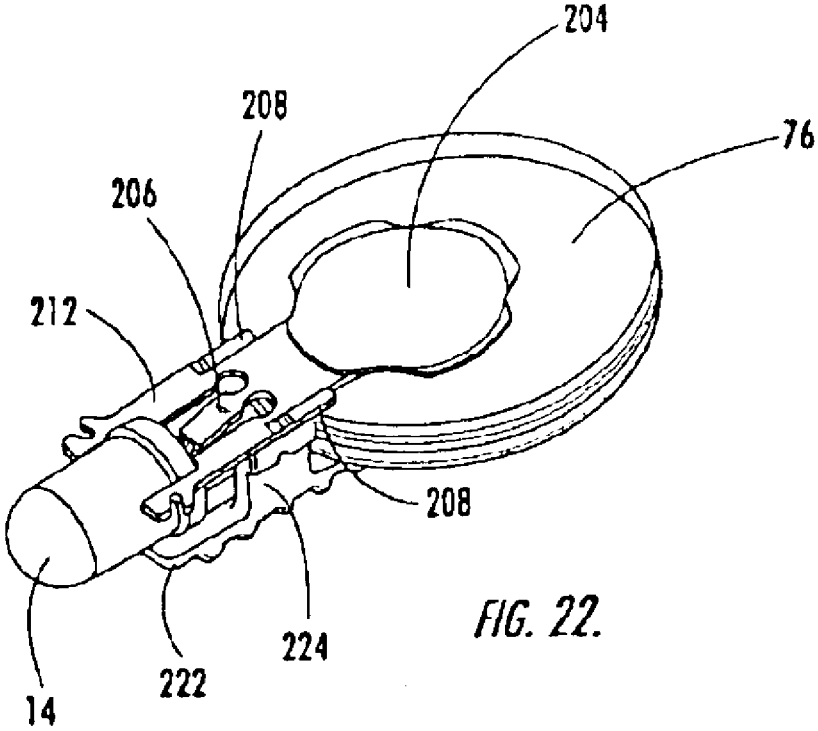
FIG. 22 is a perspective view of the miniature flashlight in the "off" position with the case and cover sections thereof removed.

Turning to FIGS. 22 and 23, the flashlight 200 in this present embodiment also includes a constant on switch function. Slide switch 222 is installed so as to be slideably operable in the bottom of housing 216. The slide switch 222 has cam surfaces 224 that exert a force on auxiliary contacts 208. As can be seen in FIG. 22 the slide switch 222 is in the off position. The slide 222 is in its rearmost position with cam surfaces 224 holding auxiliary contacts 208 up and out of electrical contact with the upper surface 76 of the top battery 18. In FIG. 21 the slide switch 222 is in its forward most position, allowing auxiliary contacts 208 to drop down onto the upper surface 78 of the battery thereby energizing the light. Auxiliary contacts 208 include a small ridge 226 that engages with a channel in the cam surface 224 of the slide switch 222 and retains it in the rear most position with the flashlight 200 off until the user intentionally exerts a force on the slide switch 222 to energize the light.

Figure 24:
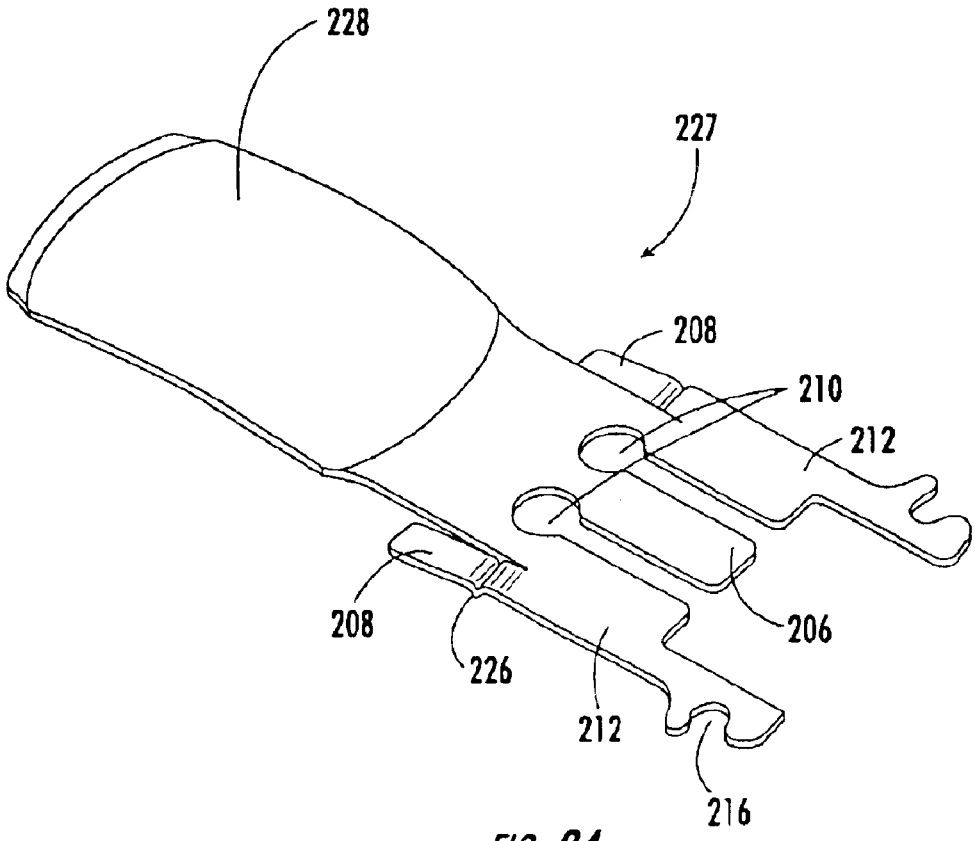
FIG. 24 Is a perspective view of a fourth embodiment of the switch for the miniature flashlight of the present invention.

Turning now to FIG. 24, another embodiment of the contact member 227 is shown as being stamped from a strip of spring metal so as to have biased contact portions as described with respect to FIG. 20. More specifically, the contact member is formed having four distinct portions including a flexible switch section 228, auxiliary contacts 208, retaining arms 212 and an LED contact clip 296. The retaining arms 212 include holes 210 to receive posts 214 located in the flashlight housing 216 which hold the contact member 227 firmly in place. Auxiliary contacts 208 are bent downwardly so as to contact the upper surface 76 of the top battery 18 in their normal resting position. LED contact clip 206 is also bent slightly downward to exert constant pressure and maintain contact with the upper contact lead 218 of LED 14. This contact member 227 is constructed as described above with respect to FIG. 20, however, the dome portion 204 is replaced simply by a flexible, arched flexible contact 228. The flexible contact 228 is spring biased to maintain the center portion in spaced relation to the battery 76. The flexible contact 228 can be depressed by the user to selectably activate the flashlight and returns to its normally off, relaxed state when released. It was determined that the side portions that originally formed the dome 204 were unnecessary and provided no additional functionality to the switch 227. By eliminating these side portions, a more effective and reliable switch 227 is created.

It can therefore be seen that the instant invention provides a small, lightweight, low cost flashlight 100 having a superior brightness level, and extended longevity. The use of a high brightness LED as a light source provides a long life light source, and the use of lithium batteries extends the normal longevity of such miniature flashlights. The simple construction and mounting of the LED, and switch configuration permit Inexpensive manufacturing and further provide the ability to easily replace the batteries and extend the longevity of the flashlight. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A flashlight assembly comprising:

a housing having a bottom wall and a side wall extending upwardly from said bottom wall;

a light emitting diode having a head portion and first and second spaced contact arms extending rearwardly from said head portion, said second contact arm having a shorter length than said first contact arm, said diode being received within said housing with said head portion of said diode being received In an aperture in said side wall of said housing, said first contact arm extending along said bottom wall of said housing and being captured within a channel formed in said bottom wall, said second contact arm resting on a raised shoulder formed within said housing;

a battery having first and second contacts, said battery being received within said housing with said second contact in electrical communication with said first contact arm of said diode; and a contact member having first and second ends, said first end being fixed in a stationary positioning electrical communication with said second contact arm of said diode, said second end of said contact member having an arched central portion, said arched central portion being normally biased to a first open position in spaced relation to said first contact of said battery, said second end of said contact member being selectively depressibly movable between said normally open first position and a second closed position in electrical communication with said first contact of said battery to selectively energize said diode.

2. The flashlight assembly of claim 1 wherein said second end of said contact member is a truncated dome switch.

3. The flashlight assembly of claim 1 wherein said contact member has a top side and a bottom side opposite to said top side, said bottom side being selectively insulated to prevent electrical communication with said battery when said contact member is in said normally open position.

4. A flashlight assembly comprising:

a housing having a bottom wall and a side wall extending upwardly from said bottom wall;

a light emitting diode having a head portion and first and second spaced contact arms extending rearwardly from said head portion, said diode being received within said housing with said head portion of said diode being received in an aperture in said side wall of said housing, said first contact arm extending along said bottom wall of said housing, said second contact arm resting on a raised shoulder of formed within said housing;

a battery having a first contact on an upper surface thereof and second contact on a lower surface there, said battery being received within said housing with said second contact in electrical communication with said first contact arm of said diode;

a flexible cover received in assembled relation with said housing to maintain said diode and said battery within said housing;

a contact member having first and second end, said first end being fixed in a stationary positioning electrical communication with said second contact arm of said diode, said second end of said contact member having an arched central section, said arched central section being normally biased to a first open position in spaced relation to said first contact of said battery, said second end of said contact member being selectively depressibly movable between said normally open first position and a second closed position in electrical communication with said first contact of said battery to selectively energize said diode, said contact member further including an auxiliary contact disposed adjacent to said first contact of said battery, said auxiliary contact being normally biased to a closed position in engagement with said first contact of said battery; and a slide switch being slideably received in said bottom wall of said housing, said slide switch being selectively slideable between a normal first position wherein said slide switch engages said auxiliary contact and forces said auxiliary contact out of engagement with said first contact of said battery and second position wherein said slide switch is disengaged from said auxiliary contact allowing said auxiliary contact to engage said first contact of said battery and energize said diode.

5. The flashlight of claim 4 wherein said second contact arm of said diode has a shorter length than said first contact arm.

6. The flashlight of claim 4 wherein said first contact arm is captured in a channel formed in the bottom wall of said housing.

7. The flashlight of claim 5 wherein said first contact arm is captured in a channel formed in the bottom wall of said housing.

8. The flashlight assembly of claim 4 wherein said second end of said contact member is a truncated dome switch.

9. The flashlight assembly of claim 1 wherein said second end of said contact member is a dome switch.

10. The flashlight assembly of claim 4 wherein said second end of said contact member is a dome switch.

* * * * *